United States Patent [19]

Weber

[11] Patent Number: 5,052,953

[45] Date of Patent: Oct. 1, 1991

[54] STACKABLE CONNECTOR ASSEMBLY

[75] Inventor: Ronald M. Weber, Lebanon, Pa.

[73] Assignee: Amp Incorporated, Harrisburg, Pa.

[21] Appl. No.: 451,282

[22] Filed: Dec. 15, 1989

[51] Int. Cl.[5] ..... H01R 11/22

[52] U.S. Cl. ..... 439/857; 439/637

[58] Field of Search ..... 439/55, 59, 60, 61, 439/62, 64, 65, 76, 78, 80, 81, 82, 629, 630, 631, 632, 633, 634, 635, 636, 637, 842, 844, 845, 856, 861, 862, 688

[56] References Cited

U.S. PATENT DOCUMENTS

| | | | |
|---|---|---|---|
| 1,865,600 | 7/1932 | Welch | 439/688 |
| 3,543,226 | 8/1968 | Laboue et al. | 439/637 |
| 3,646,504 | 9/1972 | Classon | 439/637 |
| 3,675,186 | 7/1972 | Jayne et al. | 439/633 |
| 4,129,351 | 12/1978 | Sugimoto et al. | 439/630 |
| 4,327,955 | 5/1982 | Minter | 439/635 |
| 4,577,922 | 4/1985 | Stipanuk et al. | 339/176 |
| 4,665,614 | 5/1987 | Stipanuk et al. | 439/326 |
| 4,820,170 | 4/1989 | Redmond | 439/66 |

FOREIGN PATENT DOCUMENTS

| | | | |
|---|---|---|---|
| 0470086 | 4/1969 | Switzerland | 439/825 |

*Primary Examiner*—Larry I Schwartz
*Assistant Examiner*—Hien D. Vu
*Attorney, Agent, or Firm*—Katherine A. Nelson

[57] ABSTRACT

An electrical connector (10) includes a plurality of terminal members (12) and means for securing the body portions (14) of the terminal members (12) together to form a stacked array. Each terminal member (12) includes a body portion having a first contact section (24) adapted to electrically engage a first electrical article (40) and a second contact section (34) adapted to engage a second electrical article (44). Each terminal member (12) further includes integral spacing means for spacing respective body portions (14) of adjacent terminal members from each other. Upon electrically engaging respective first and second contact sections (24, 34) of the plurality of terminal members (12) with corresponding first and second electrical articles (40, 44), the terminal members (12) provide a plurality of paths for current flow between the first and second electrical articles (40, 44).

10 Claims, 5 Drawing Sheets

STACKABLE CONNECTOR ASSEMBLY

FIELD OF THE INVENTION

This invention is directed to an electrical connector assembly and more particularly to an assembly for mating with flat bar like members.

BACKGROUND OF THE INVENTION

In forming both power and signal distribution systems, it is necessary to provide interconnections between various members and components of the systems. One major requirement of any connector system is that it be reliable and stable over a life span. For many integrated circuit systems there can be no more than a five percentage voltage drop throughout the system. Each connection, therefore, can only have a very small percentage of the total voltage drop It is therefore essential that the connectors be designed to minimize the millivolt drop (MVD) at each termination. The system generally includes one or more interconnections between bus bars or the like, which typically carry a high current and low voltage. In order to reduce the MVD, it is desirable to have a plurality of parallel current paths for current to flow between the interconnected members. It is desirable, therefore, to have a means whereby the amount of normal force required for effective interconnection and the resistance of an interface may be effectively reduced.

SUMMARY OF THE INVENTION

Accordingly, to alleviate the disadvantages and deficiency of the prior art, the present invention is directed to an electrical connector having means that provides a plurality of electrical contact paths in parallel for electrical engagement at the interface between respective conductive surfaces of first and second electrical articles upon being fastened therebetween. The connector comprises a plurality of like terminal members, each of the terminal members including a first contact section adapted to electrically engage a common conductive surface of a first electrical article, a second contact section adapted to engage a common conductive surface of a second electrical article, and integral means for spacing adjacent terminal members from each other; and means for securing the terminal members together to form a stacked array. One of the first or second contact sections is bifurcated to engage opposed surfaces of the corresponding electrical article.

In the preferred embodiment the first contact section includes a pair of outwardly extending cantilevered beam arms defining an opening for receiving a bar shaped member such as a bus bar therein and the second contact section includes pin terminal members for electrical connection to plated through holes in a back plane or circuit board. Upon securing the array of terminal members together and electrically engaging the first contact section thereof with the common conductive surface of the first electrical article and the common conductive surface of second contact section with a second electrical article, a plurality of parallel paths for current flow between the first electrical article and the second electrical article is established. It is to be understood that the configuration of the first and second contact sections will vary depending upon the type of electrical articles being interconnected by the connector of the invention.

It is an object of the invention to provide a reduced normal force of the mating interface between two electrical articles.

It is a further object to provide an electrical connector having a reduced interface resistance suitable for use with electrical systems for carrying power or for carrying signals.

It is yet another object of the invention to provide an electrical connector having terminals that can be readily stamped and formed.

Another object of the invention is to provide a connector having a plurality of electrical terminal members that can be stacked together such that the width of the connector can be readily adjusted to accommodate various widths of conductive areas.

A still further object of the invention is to provide a connector having a plurality of electrical terminal members that can be readily combined to achieve more desirable electrical characteristics.

The invention itself, together with further objects and its intended advantages, will be best understood by reference to the following detailed description taken in conjunction with the following drawing

DETAILED DESCRIPTION OF THE DRAWINGS

Figure 1:
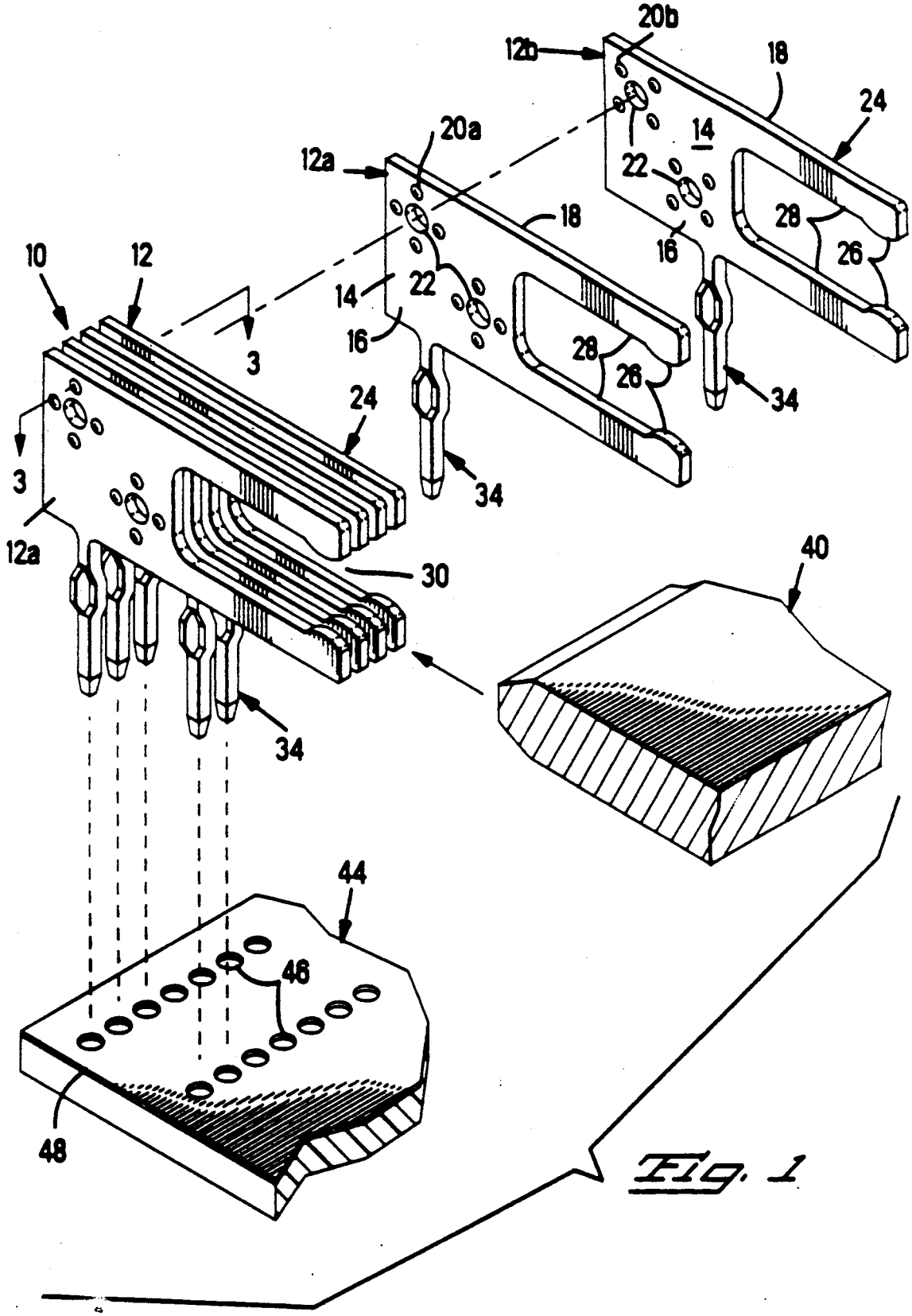
FIG. 1 is a perspective view of a partially exploded electrical connector made in accordance with the present invention exploded from one electrical article and another electrical article positioned for electrical engagement with the connector.
Figure 2:
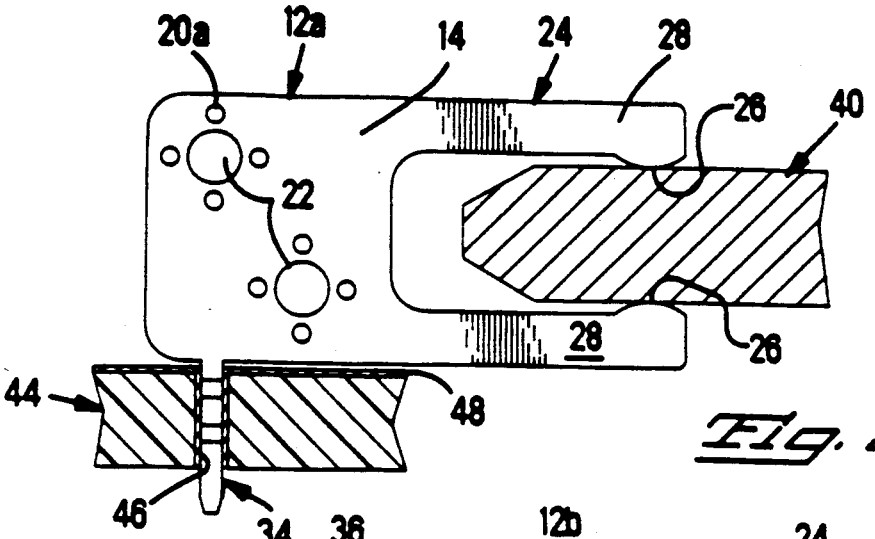
FIG. 2 is a cross-sectional view of a connector of FIG. 1 electrically engaged with two electrical articles.
Figure 3:
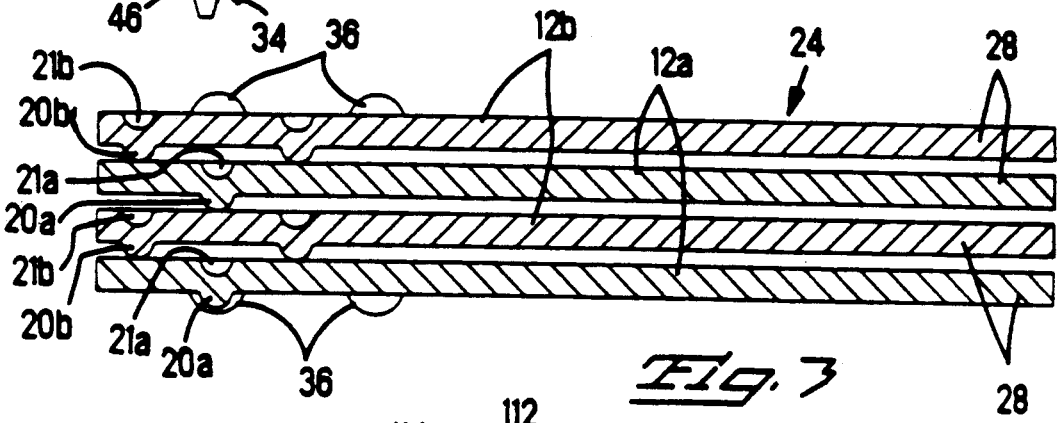
FIG. 3 is a cross sectional view taken along line 3—3 of the electrical connector of FIG. 1 and illustrating the spacing means.

Referring now to FIGS. 1, 2 and 3, electrical connector 10 is comprised of a plurality of terminal members, referred to generally as 12, each terminal member 12 having first and second connecting portions 24, 34 adapted to electrically engage respective common conductive surfaces of first and second electrical articles 40, 44 and spacing means 20*a*, 20*b* for maintaining adjacent terminal members 12 in a spaced relationship, the connector 10 further including means 36 for securing the terminal members 12 together to define a stacked array, as shown in FIG. 3. As best seen in FIG. 1, terminal members 12 have two different configurations, 12*a* and 12*b*, depending primarily upon whether the terminal has spacing means 20*a* or 20*b*, as more fully explained below. Each terminal member 12 includes a plate-like body section 14 having opposed major surfaces 16, 18 and a plurality of apertures 22 extending therethrough for receiving securing means 36 therethrough. First connecting portion 24 is bifurcated into compliant beams 28 that coextend in parallel from side edges of common body section 14, each beam including respective contact surface 26 thereon for engaging opposed surface 41, 43 a first electrical article 40, as shown in FIG. 1. In the embodiment shown in these Figures, the first contact section 26 of each terminal member 12*a*, 12*b* is shown as a pair of opposed cantilevered beam arms 28. In the assembled connector, contact sections 26 define a slot 30 therebetween for receiving first conductive article 40. The second connecting portion 34 is shown as a compliant pin member adapted to be securing into through-holes 46 of second electrical article, shown as circuit board 44. To provide a better arrangement for locating the through-holes 46 on circuit board 44, the pin members 34 extend alternatively from rearward and forward sections of the lower edge of terminal members 12*a*, 12*b* respectively. It is to be understood that the legs of pin or post members may also extend from the rearward section edge for mounting in a back panel. It is to be further understood that other configurations of connecting portions may also be used in accordance with the invention for either or both the first and second connecting portions.

In the preferred embodiment of terminal members 12*a*, 12*b*, the first major surface shown as 16 in FIG. 1 includes a plurality of protrusions or embossments 20*a*, 20*b* respectively which provide points of electrical contact and spacing means for spacing adjacent terminal body sections 14 from each other thereby permitting independent deflection of the beam members 28. These embossments 20*a*, 20*b* are shown as four points around respective apertures 22. The protrusions 20*a*,20*b* are made by stamping or embossing from the second major side 18, thereby creating corresponding dimples 21*a*, 21*b* on second major side 18 as best seen in FIG. 3. In terminal 12*a*, the embossments 20*a* are arranged essentially in horizontal and vertical positions. In terminal 12*b* embossments 20*b* are arranged diagonally around apertures 22. Thus embossments 20*b* of terminal 12*b* will engage a flat area of the second major surface 18 of terminal 12*a* rather than the dimples 21*a*. The alternating relationship of the embossments 20*a*,*b* and dimples 21*a*,*b* is best seen in FIG. 3. Embossments 20*a*,*b* provide four points of electrical contact between adjacent terminal members 12 around each respective aperture 22.

Upon assembly of the connector as shown in FIG. 1 the plurality of terminal members 12 form a stacked array having corresponding first connecting portions 24 aligned to form a continuously extending mouth or slot 30 for receiving a first electrical article, shown as bus bar member 40. The plurality of terminal members 12 are secured together by fastening means 36 as shown in FIG. 3. The respec ive contact portions 26 on each of the terminal members 12 engage the conductive bus bar member 40 and provide a plurality of circuit paths to carry the current of the bus bar member 40 by means of plated through-holes 46 to common conductive surface 48 of circuit board 44.

Figure 4:
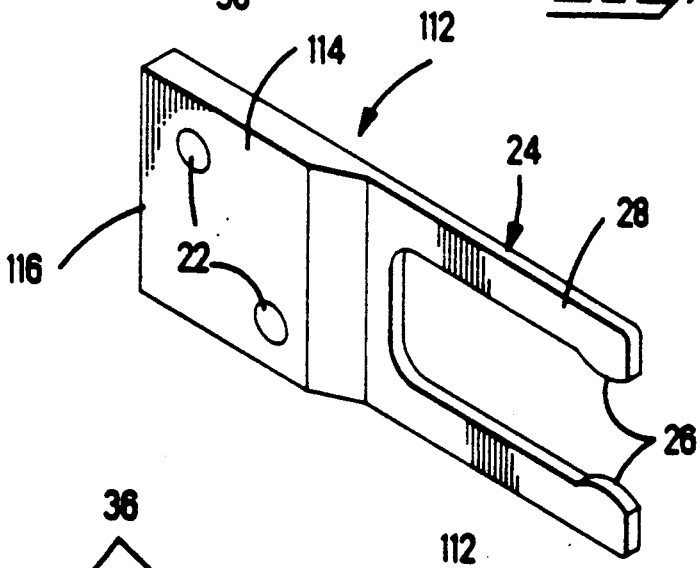
FIG. 4 is an alternative embodiment of a terminal member made in accordance with the invention and having alternative spacing means.
Figure 5:
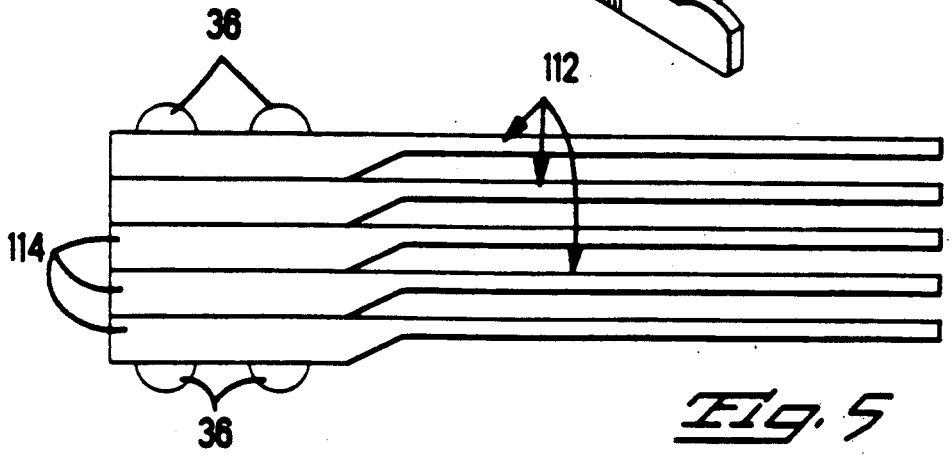
FIG. 5 is a top plan view of an electrical connector having a plurality of terminal members of FIG. 4.

FIGS. 4 and 5 illustrate a alternative embodiment 112 of the terminal of the invention whereby a major surface 116 of the terminal member 112 is milled to provide a thicker body portion 114 as compared with the outwardly extending first connecting portion 24. As seen from FIG. 7, the thicker body portion 114 provides spacing between the beam arms 28 of adjacent terminals 112 thereby providing independent deflection of the beam arms 28 upon mating with a first electrical article. For purposes of illustration, the second connecting means has been eliminated from this alternative embodiment.

Figure 6:
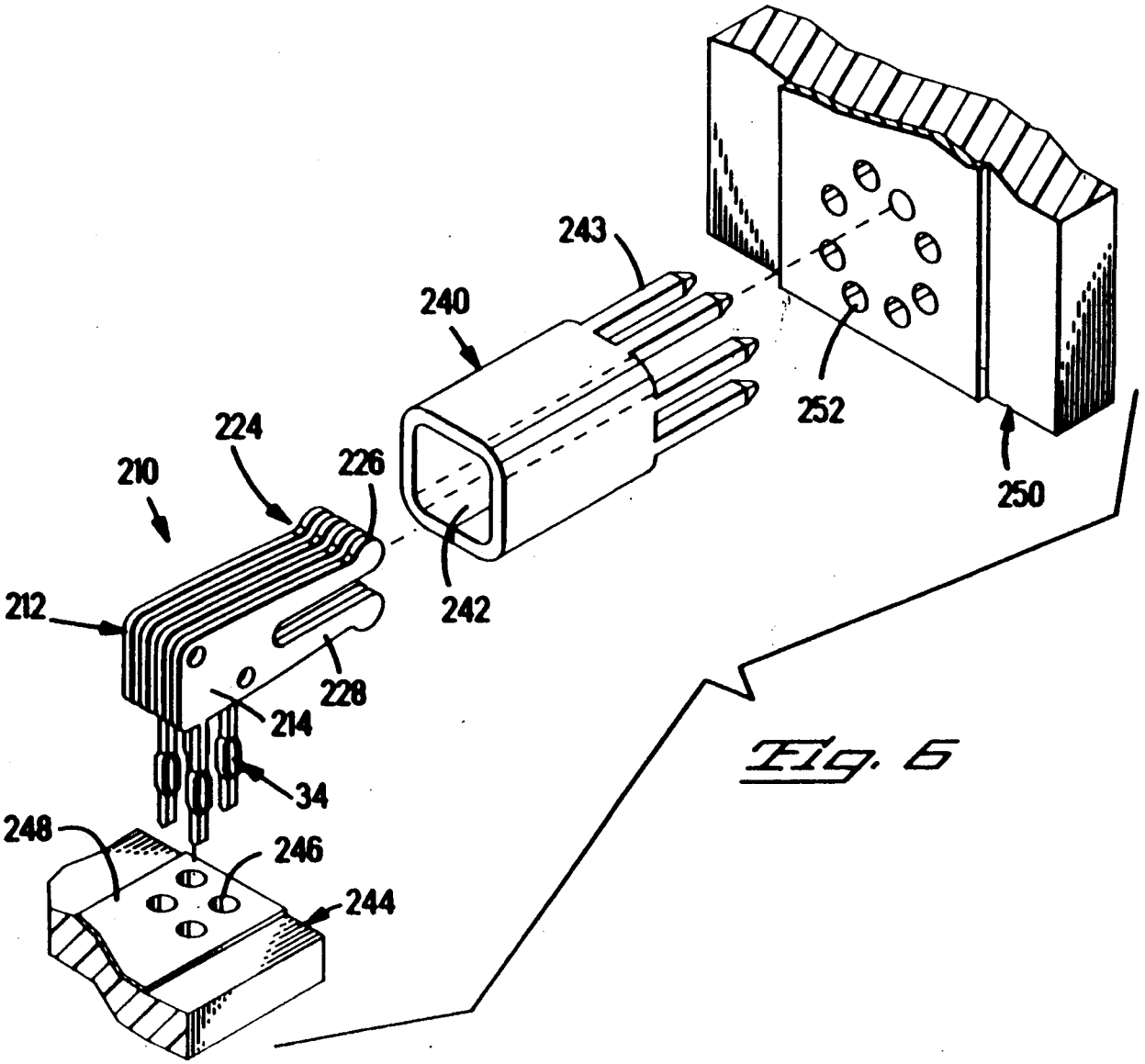
FIG. 6 is an alternative embodiment of a connector made in accordance with the invention and having terminal members adapted for mating with a receptacle member, the connector and mating receptacle member being exploded from a circuit board and back plane respectively.

FIG. 6 shows an alternative connector embodiment 210 for having terminal member 212 in which the first connecting portion 224 includes first contact portions 226 on outward surfaces of compliant arms 228 for electrically engaging inner surfaces 242 of a first electrical article shown as receptacle member 240. For purposes of illustration, details of the spacing means have been eliminated from terminal member 212 and receptacle member 240 is shown with posts 243 for mounting into through-holes 252 on circuit board 250.

Figure 7:
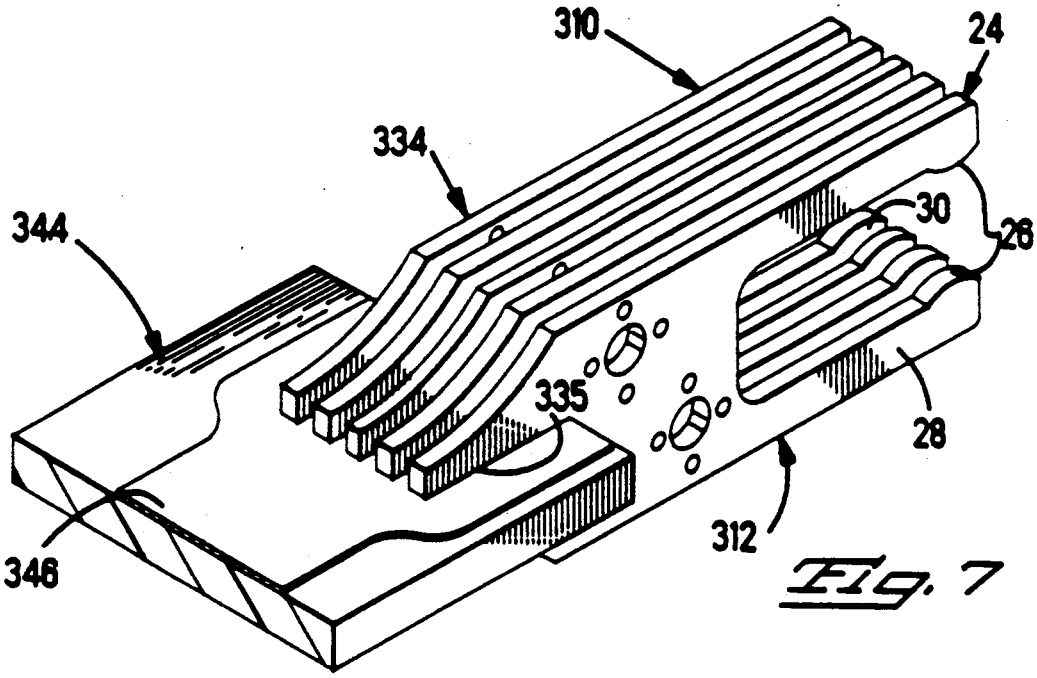
FIG. 7 is a perspective view of alternative embodiment of the connector electrically engaged with an electrical article.
Figure 8:
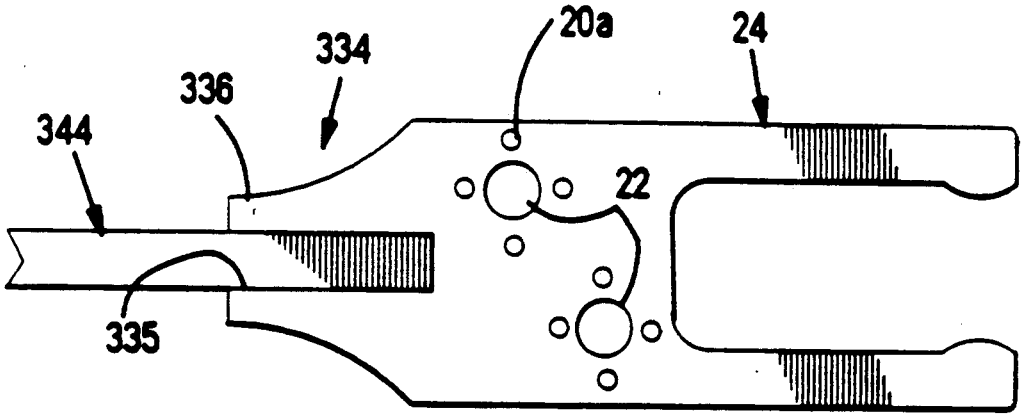
FIG. 8 is a cross-sectional view of a terminal member of the connector of FIG. 7.

FIGS. 7 and 8 illustrate a further alternative embodiment 310 of the connector made in accordance with the invention in which the second connecting means 334 includes slot 335 extending from an exterior edge thereof, for receiving circuit board member 344 therein thereby defining solder posts 336 which can be soldered to a conductive surface 346 as shown in FIG. 7.

Figure 9:
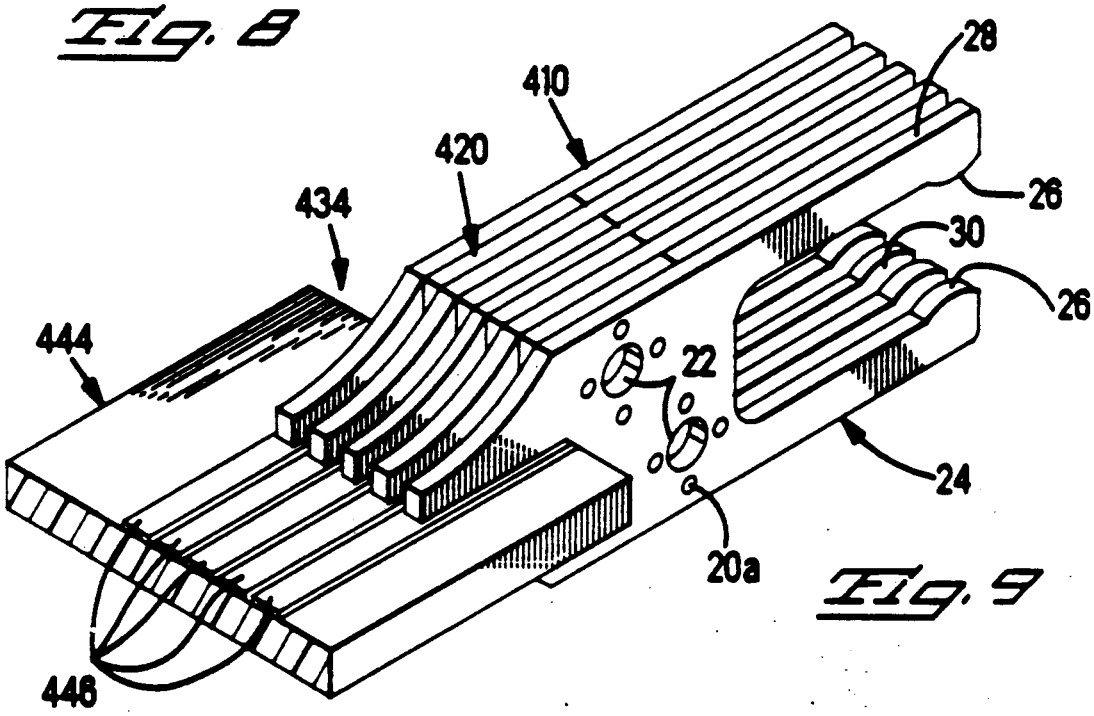
FIG. 9 is a further alternative embodiment of a connector made in accordance with the invention and electrically engaged with a plurality of conductors on a circuit board.

FIG. 9 shows a further alternative embodiment 410 of a connector in which terminal members 412 are further spaced apart by dielectric spacing means 420 thereby providing a plurality of electrically isolated terminal members for interconnecting a plurality of circuit pads 446 of circuit board 444 to corresponding conductive areas of another electrical article (not shown). Dielectric spacing means 420 extends essentially between the body portions 414 of adjacent terminal members 412 thereby retaining the independent movement of a compliant means 28 of the terminal. The dielectric spacing means needs to be of sufficient thickness to maintain electrical isolation between adjacent terminal members 412. To ensure electrical isolation, terminal members 412 would be secured together by insulated fasteners (not shown), such as bolts or the like.

Figure 10:
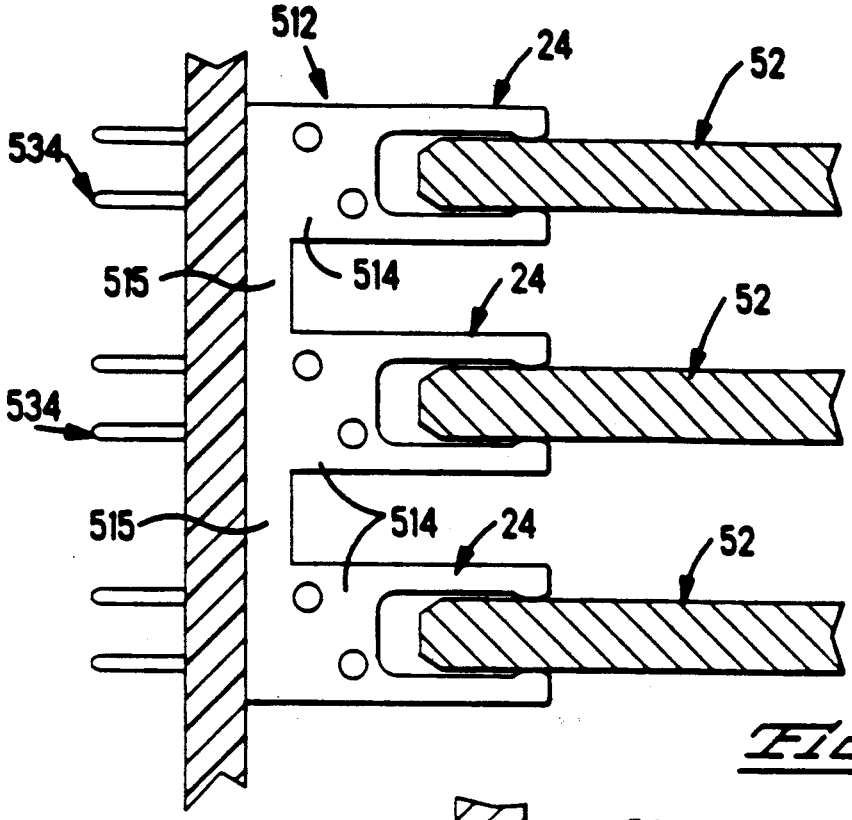
FIG. 10 is a side view of another embodiment of the terminal member for interconnecting a plurality of electrical articles.

FIG. 10 is a further embodiment 512 of a terminal member for a connector made in accordance with the present invention. Terminal member 512 includes an integrally continuously extending strip portion 515 having a plurality of first contact sections 24 extending outwardly in a first direction therefrom and a plurality of second contact sections 534 extending rearwardly from an opposed edge of strip 515. For purposes of illustration terminal member 512 is shown with three first and second contact sections 24, 534. A connector comprised of terminals of this type may be used, for example, to common a plurality of bus bars 52 with a ground conductor of a backplane or the like.

Figure 11:
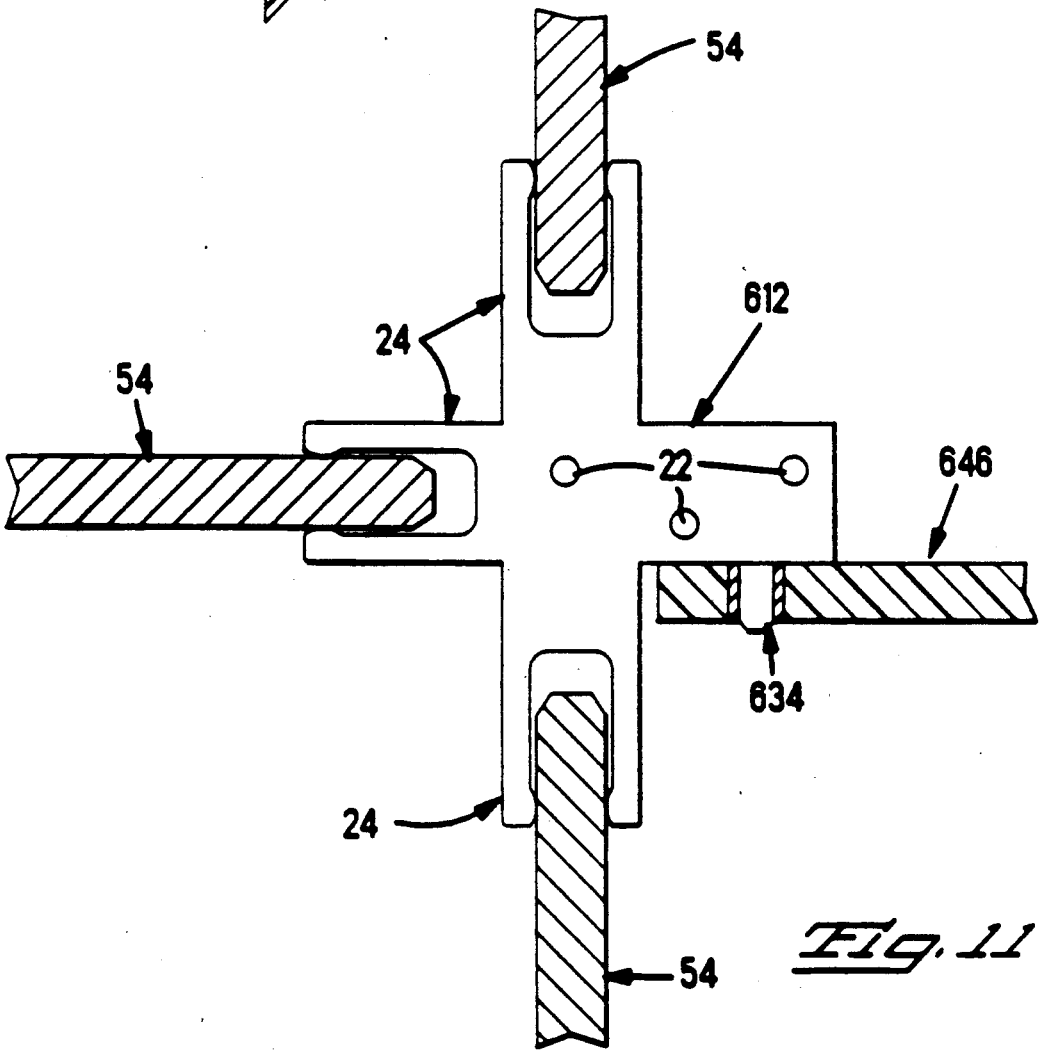
FIG. 11 is a top plan view of a further embodiment of a terminal member for interconnecting a plurality of electrical articles.

FIG. 11 is a further embodiment of a terminal member 12 for use commoning conductive surfaces of a plurality of members shown as bus bars 54 to a conductive surface of a second electrical article 646.

The present invention provides an electrical terminal member that may be used for power connections or other connections in which the MVD needs to be reduced. The terminal member has a plurality of contact beams to decrease the resistance through the contacts for electrically connecting a common surface of a first electrical member to a second electrical article. The contact terminal is intended to be mated with a blade like member receivable between a compliant beam or may be mated with a box like member which receives the plurality of cantilevered beams therein.

The electrical contact terminal as disclosed herein and shown in the accompanying Figures, provides a terminal that can be manufactured in a cost effective stamped and formed manner and permits the use of many grades of materials and combinations of materials as long as the selected material has the desired electrical and mechanical properties. The material selected should have a high conductivity but in addition have low stress relaxation and adequate yield strength to exert sufficient normal force at the mating interface of the connector contact areas and the respective electrical articles. With beam members, it is also important to select a material that will not stress relax over time and cause an increase in the interface resistance, which results in a drop in the amount of current which can be carried through the terminals. Suitable materials include copper alloys, such as Olin C-151 or C-194, which are available from Olin Brass, East Alton, Ill. C-151 has 85% to 95% of the conductivity of pure copper yet retains very good mechanical properties, such as tensile strength and low stress relaxation. C-194 has about 65% of the conductivity of pure copper and somewhat better mechanical properties than C-151. Since the mechanical and electrical capabilities of individual terminal members can essentially be defined by the selected material, the normal force and the interface resistance of an interconnection can be lowered by using a stack of terminal members.

It is thought that the electrical contact terminal of the present invention and many of its attendant advantages will be understood from the foregoing description. Changes may be made in the form, construction and arrangement of parts thereof without departing from the spirit and scope of the invention or sacrificing all of its material advantages.

I claim:

1. An electrical connector for providing a plurality of contact paths between a common conductive area of at least one first electrical article and a corresponding common conductive area of at least one second electrical article, said connector comprising:

a plurality of terminal members, each said terminal member including a plate-like body portion having at least one first contact section adapted to electrically engage a corresponding first electrical article and at least one second contact section adapted to engage a corresponding second electrical article, the thickness of the material forming the terminal body portion being substantially thicker than the thickness of the material forming the at least first contact portion, at least one of said first and second contact sections being bifurcated to engage opposed surfaces of the corresponding electrical article to be mated thereto, said bifurcated contact section including compliant beams coextending in parallel from side edges of a common body section, said body section having a width that is greater than the thickness of the electrical article to which said bifurcated contact section is to be mated;

each said terminal member further including integral spacing means for spacing respective body portions of adjacent terminal members from each other, said spacing means being defined by said thicker body portion; and means for securing said body portions of said terminal members together to form a stacked array; whereby upon electrically engaging respective ones of each said at least one first contact section of said plurality of terminal members with said corresponding first electrical article and respective ones of each said at least one second contact section of said plurality of terminal members with corresponding said second electrical article, said terminal members provide a plurality of paths for current flow between said common area of said first electrical article and said common area of said second electrical article.

2. The connector of claim 1 wherein said opposed coextending compliant beam members include contact surfaces on internal surfaces thereof.

3. The connector of claim 1 wherein said opposed coextending compliant beam members include contact surfaces on external surfaces thereof.

4. The connector of claim 1 wherein said integral spacing means further includes a plurality of protuberances on said body portions of each said terminal member.

5. The connector of claim 1 further including dielectric spacing means disposed between at least body portions of adjacent terminal members thereby isolating respective ones of said plurality of current paths.

6. An electrical connector for providing a plurality of contact paths between a common conductive area of at least one first electrical article and a corresponding common conductive area of at least one second electrical article, said connector comprising:

a plurality of terminal members, each said terminal member including a plate-like body portion having a first contact section adapted to electrically engage a first electrical article and a corresponding second contact adapted to engage a second electrical article, the thickness of the material forming the terminal body portion being substantially thicker than the thickness of the material forming the at least first contact portion, at least one of said first and second contact sections being bifurcated to engage opposed surfaces of the corresponding electrical article to be mated thereto, said bifurcated contact section including compliant beams coextending in parallel from side edges of a common body section, said body section having a width that is greater than the thickness of the electrical article to which said bifurcated contact section is to be mated;

each said terminal member further including integral spacing means for spacing respective body portions of adjacent terminal members from each other, said spacing means being defined by said thicker body portion; and means for securing said body portions of said terminal members together to form a stacked array; whereby upon electrically engaging first contact sections of said plurality of terminal members with said first electrical article and the corresponding second contact sections of said terminal members with said second electrical article, said terminal members provide a plurality of paths for current flow between said common area of said first electrical article and said common area of said second electrical article.

7. The connector of claim 6 wherein said opposed coextending compliant beam members include contact surfaces on internal surfaces thereof.

8. The connector of claim 6 wherein said opposed coextending compliant beam members include contact surfaces on external surfaces thereof.

9. The connector of claim 6 wherein said integral spacing means further includes a plurality of protuberances on said body portions of each said terminal member.

10. The connector of claim 6 further including dielectric spacing means disposed between at least body portions adjacent terminal members thereby isolating respective ones of said plurality of current paths.

* * * * *